US006364563B1

(12) United States Patent
Cheng

(10) Patent No.: US 6,364,563 B1
(45) Date of Patent: Apr. 2, 2002

(54) JOINT FOR A PLAYPEN

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 09/686,861

(22) Filed: Oct. 12, 2000

(51) Int. Cl.[7] ..... F16C 11/10
(52) U.S. Cl. ..... 403/102; 403/218; 5/99.1
(58) Field of Search ..... 403/100, 101, 403/102, 218; 5/99.1

(56) References Cited

U.S. PATENT DOCUMENTS 5,483,710 A * 1/1996 Chan ..... 403/102 X
5,730,542 A * 3/1998 Cheng ..... 403/102
6,202,229 B1 * 3/2001 Cheng ..... 403/102 X

* cited by examiner

*Primary Examiner*—Lynne H. Browne
*Assistant Examiner*—John R. Cottingham
(74) *Attorney, Agent, or Firm*—Rosenberg, Klein & Lee

(57) ABSTRACT

A joint for a playen has a main base, two plate hooks, two wing bases and a press block. The wing bases are pivoted to the main base, and each connected to a support rod of the playen. The plate hooks are fixed to the press block, and each has two end barbs. The press block is movably connected to the main base with a guide pin passed through two aligned shaped holes of the main base; the guide pin is also passed through a long vertical hole of the press block. The joint is spread at an unfolded position with locating pins of the wing bases engaging the barbs of the plate hooks. To fold the joint, the wing bases is pivoted inwardly of the main base, and the press block is pushed up to disengage the locating pins from the barbs; the guide pin can move in the shaped hole sideways to permit the press block to move sideways, helping the barbs separate from the locating pins of the wing bases easily.

1 Claim, 7 Drawing Sheets

JOINT FOR A PLAYPEN

BACKGROUND OF THE INVENTION

The present invention relates to a joint for a playen, and particularly to one which can be collapsed and spread easily without possibility of getting damaged by incorrect operation due to only a barb release from a pin, and user may use big force to collapse the other barb to result in damaging support rods of the playen.

Referring to FIGS. 8 and 9, a conventional joint for a playen that was patented in U.S. Pat. No. 5,730,542, has a main base 5, two wing bases 6, a press block 7 and two elongated plate hooks 8.

The main base 5 has two lengthwise side portions 51, 52, and an upper arch-shaped bridge 53 connecting upper ends of the lengthwise side portions 51, 52. The main base 5 has a center hole 531 with an annular curved-down 532 (FIG. 9) on the upper arch-shaped bridge 53. The side portions 51, 52 each has two position holes 511, 521; the position holes 511 are each aligned with a corresponding one of the position holes 521.

The wing bases 6 are formed of V-shaped plates, and each connected to a support rod of the playen, and are pivoted to the main base 5 from the position holes 511, 521 by means of pins 63.

The depress block 7 has two vertical slots 71 parallel to each other, two side recesses 72, a through hole 721 on the side recesses 72, and an upper recesses 73. The elongate plate hooks 8 are each fixed to one of the side recesses 72 by means of a pin 84 connected to the hole 721. The plate hooks 8 each has two guide curves 81 on outer ends and two barbs 82. The depress block 7 is disposed under the arch-shaped bridge 53 of the main base 5 with a spring 54 disposed in between; the spring 54 is connected to the curved-down edge 532 and the upper recess 73 to bias the press block 7 downwardly.

Two pins 56 are provided, each passed through a respective one of the vertical slots 71 of the press block 7 and the lengthwise side portions 51, 52 such that the press block 7 can be moved up and down, confined by the vertical slots 71.

The wing bases 6 each further has a pin 62, 64 fixed to a lower portion to engage the barbs 82 of the plate hooks 8 to support the playen in a spread position.

To fold the playen, first the support rods are pivoted inwardly of the main base 5 to disengage the pins 62, 64 from the barbs 82. Then, the depress block 7 is moved up and the support rods are pivoted outwardly of the main base 5; the pins 62, 64 of the wing bases 6 will contact the guide curves 81 of the plate hooks 8, permitting the support rods to be pivoted further up for the joint to be folded.

However, the above joint for a playen is found to have a disadvantage that one of the pins 62 or 64 which engage the barbs 82 is likely to engage the barbs 82 when the other one has disengaged, and the corresponding support rod has been moved to the folded position due to a somewhat tight connection between the wing bases 6 and the main base 5. In this case, the user might exert big force to try to move the support rod which is still fixed by the plate hook 8 without first disengaging the pin 62 or 64 from the barbs 82. Consequently, the associated parts and the support rod itself might get damaged.

SUMMARY OF THE INVENTION

Therefore, it is a main object of the present invention to provide a joint for a playen, which can be folded very easily and without possibility of damaging the parts when a shaped hole is provided.

The joint of a playen of the present invention includes a main base, two wing bases, a press block and two elongated plate hooks.

The main base has two lengthwise side portions and an upper arch-shaped bridge connecting tops of the side portions. The side portions each has a shaped hole shaped like a water chestnut.

The wing bases are pivoted to the side portions of the main base and each connected to a support rod of a playen. The wing bases each has a locating pin fitted thereto.

The press block is movably connected to the main base, and has a long vertical guide hole. A guide pin is passed through the guide hole and the shaped hole of the main base to confine a movement of the press block.

The elongated plate hooks are fixed to the press block, and each has two end barbs.

The support rods are supported at a spread position by means of the locating pins engaging the barbs. To move to the support rods to a folded position, the support rods are slightly pivoted inwardly of the main base, and the press block is pushed up; thus, the support rods can be pivoted upwards to the folded position. The guide pin can move in the shaped holes sideways to permit the press block to move sideways, helping the barbs to separate from the locating pins of the wing bases easily in can one of the locating pins fails to disengage from the barbs in the above said operation.

BRIEF DESCRIPTION OF THE DRAWINGS

This invention will be better understood by referring to the accompanying drawings, wherein.

DESCRIPTION OF THE PREFERRED EMBODIMENT

Figure 1:
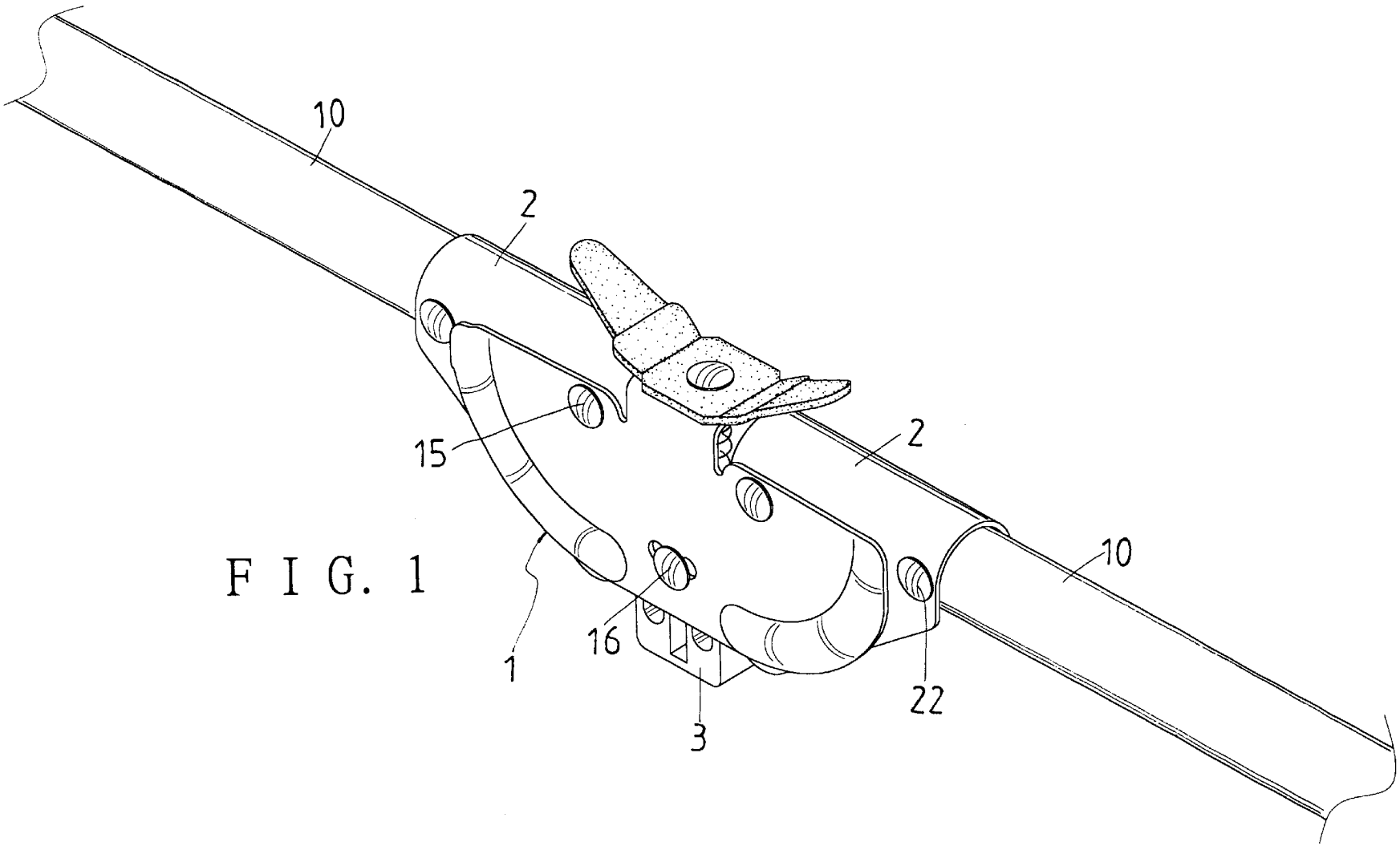
FIG. 1 is a view of the joint for a playen of the present invention.
Figure 2:
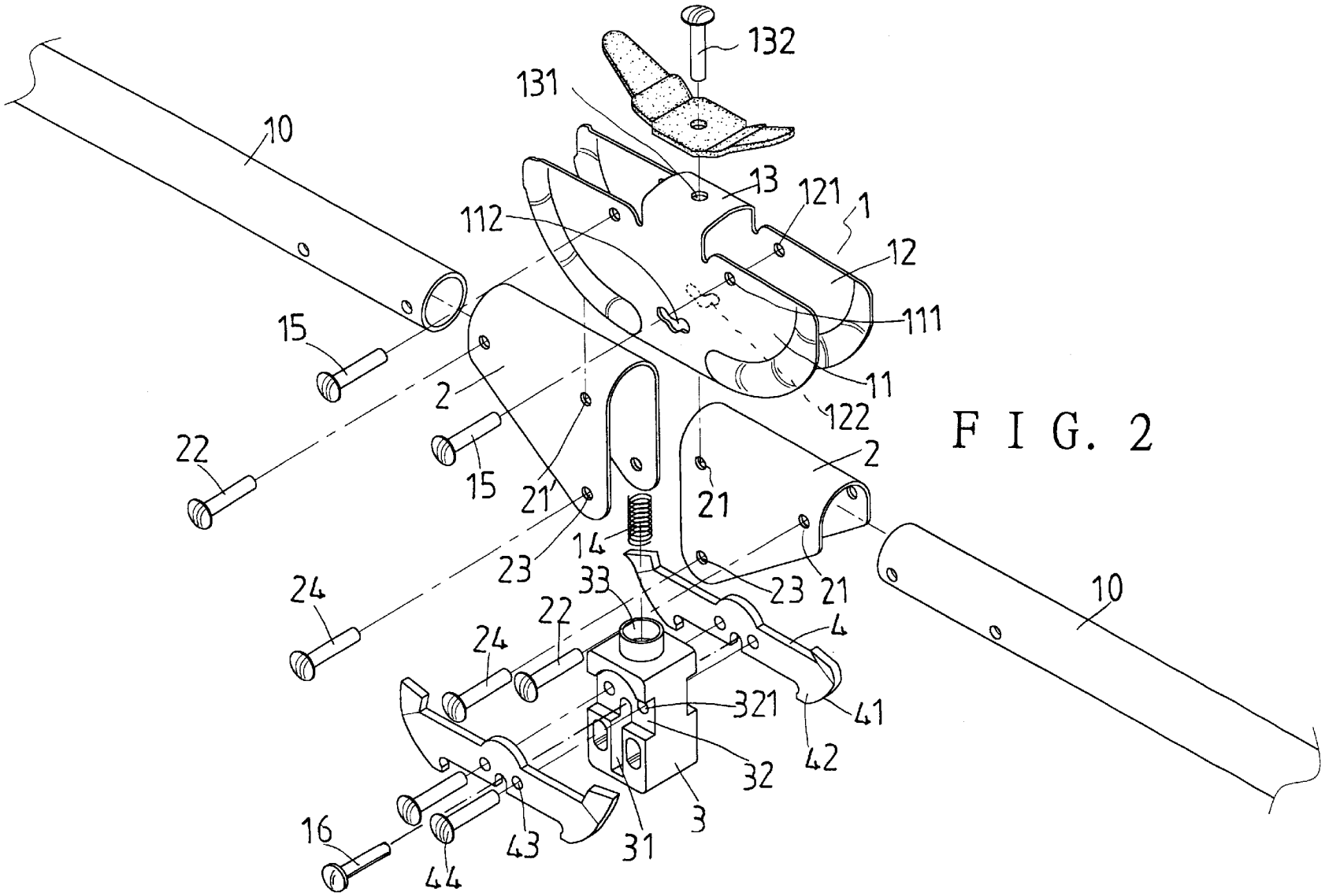
FIG. 2 is an exploded perspective view of the joint for a playen of the present invention.

Referring to FIGS. 1 and 2, a joint of a playen of the present invention has a main base 1, two wing bases 2, a press block 3 and two elongated plate hooks 4.

The main base 1 has two lengthwise side portions 11, 12 and an upper arch-shaped bridge 13 connecting upper ends of the lengthwise side portions 11, 12. The upper arch-shaped bridge 13 has a hole 131 thereto; a pin 132 is passed through the hole 131. The side portions 11, 12 have two pivotal holes 111, 121 respectively; the pivotal holes 111 are each aligned with a corresponding one of the pivotal holes 121. The side portions 11, 12 further has a shaped hole 112, 122 respectively on a middle portion; the shaped holes 112, 122 each has a central portion, and two side extension portions connecting the central portion, substantially looking like a water chestnut.

The wing base 2 is each formed of an U-shaped plate, and each has pin holes 21, 21', and locating pin holes 23; the pin holes 21 of each of the wing bases 2 are aligned with each other; so do the pin holes 21' and the locating pin holes 23.

Support rods 10 of the playen are each connected to a respective one of the wing base 2 by means of pins 22 passed through the pin holes 21, 21' and the support rods 10. Moreover, the pins 22 passed through the pin holes 21' are passed through the pivotal holes 121 of the main base 1 to pivot the wing base 2 and the support rods to the main base 1.

The press block 3 has a long vertical guide hole 31, two locating recesses 32 on two opposite sides, and a locating room 33 on a top end. The locating recesses 32 have through holes 321. The press block 3 is disposed under the arch-shaped bridge 13 of the main base with a spring 14 disposed in between; the spring 14 is connected to the pin 132 and the locating room 33 from two end portions. A guide pin 16 is passed through the vertical guide hole 31 of the press block 3, and the shaped holes 112, 122 of the main base 1 such that the press block 3 can be moved in a path confined by the guide hole 31 and the shaped hole 112, 122.

The elongated plate hooks 4 each has two guide curves 41 and two barbs 42 on two end portions. The elongated plate hooks 4 are each fixed to a respective one of the locating recesses 32 by means of pins 43 riveting through holes 43 of the plate hooks 4 and the through holes 321 of the press block 3.

Figure 3:
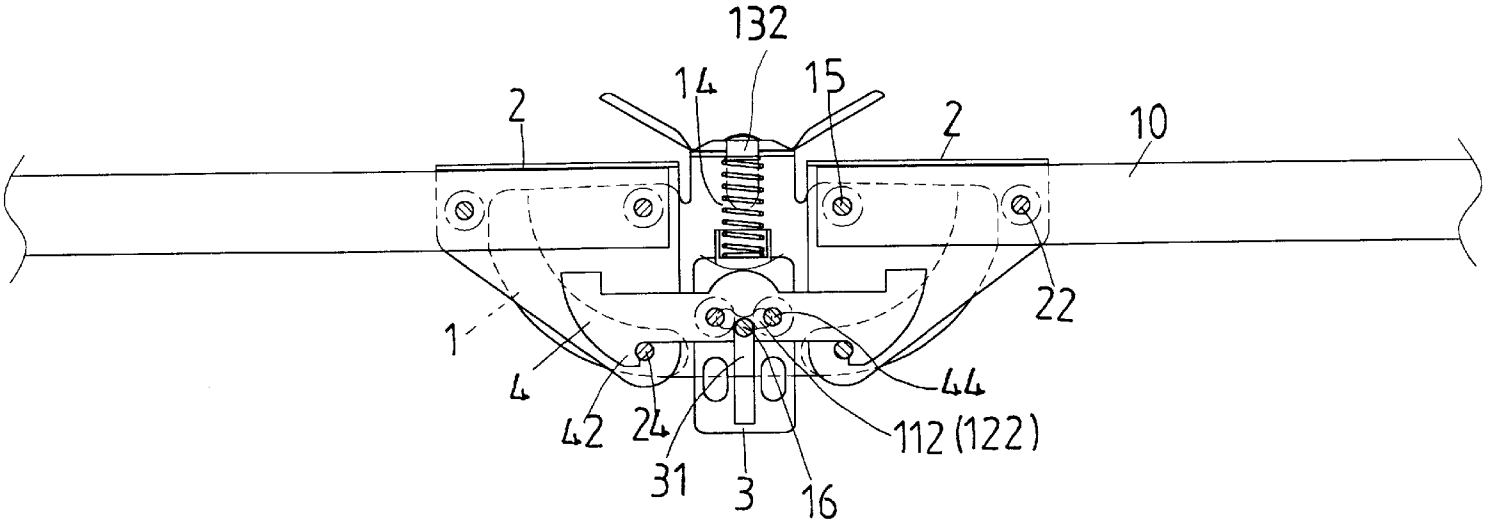
FIG. 3 is a cross-sectional view of the joint for a playen of the present invention.

The wing bases 2 each further has a locating pin 24 connected to holes 23 thereof such that the locating pins 24 can engage the barbs 42 at two ends of the elongated plate hooks 4 to support the joint at a spread position as shown in FIG. 3.

Figure 4:
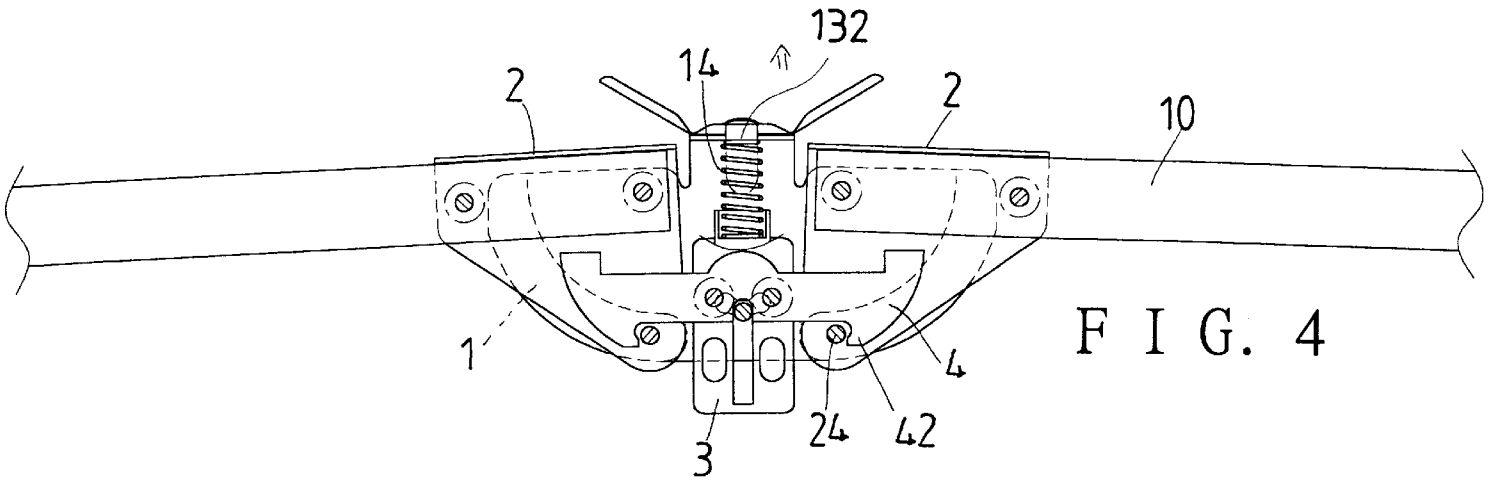
FIG. 4 is a cross-sectional view of the joint in FIG. 3, under a first step of folding movement.
Figure 6:
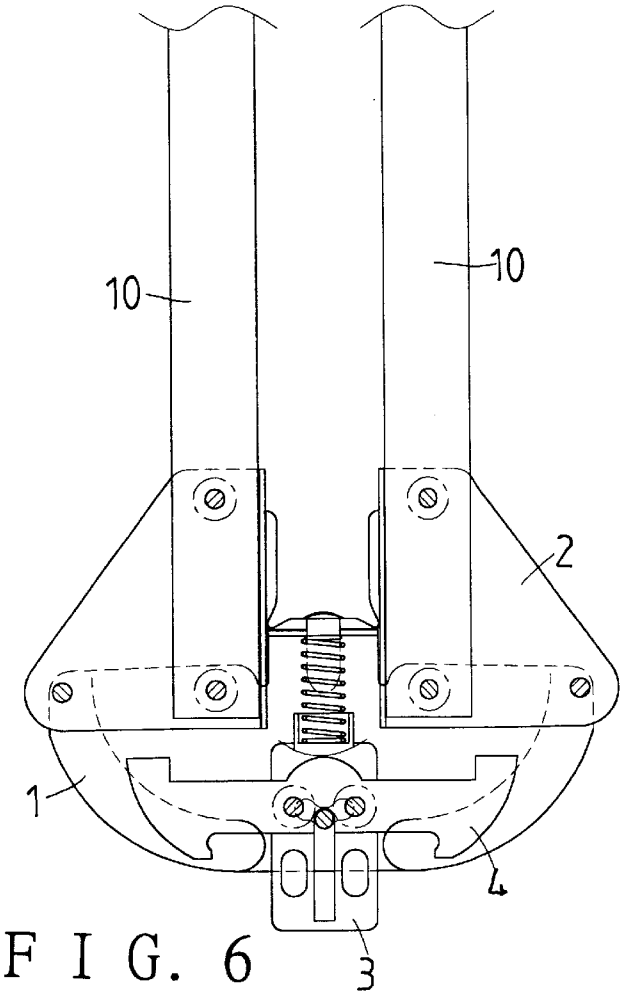
FIG. 6 is a cross-sectional view of the joint in FIG. 3, at a folded position.
Figure 5:
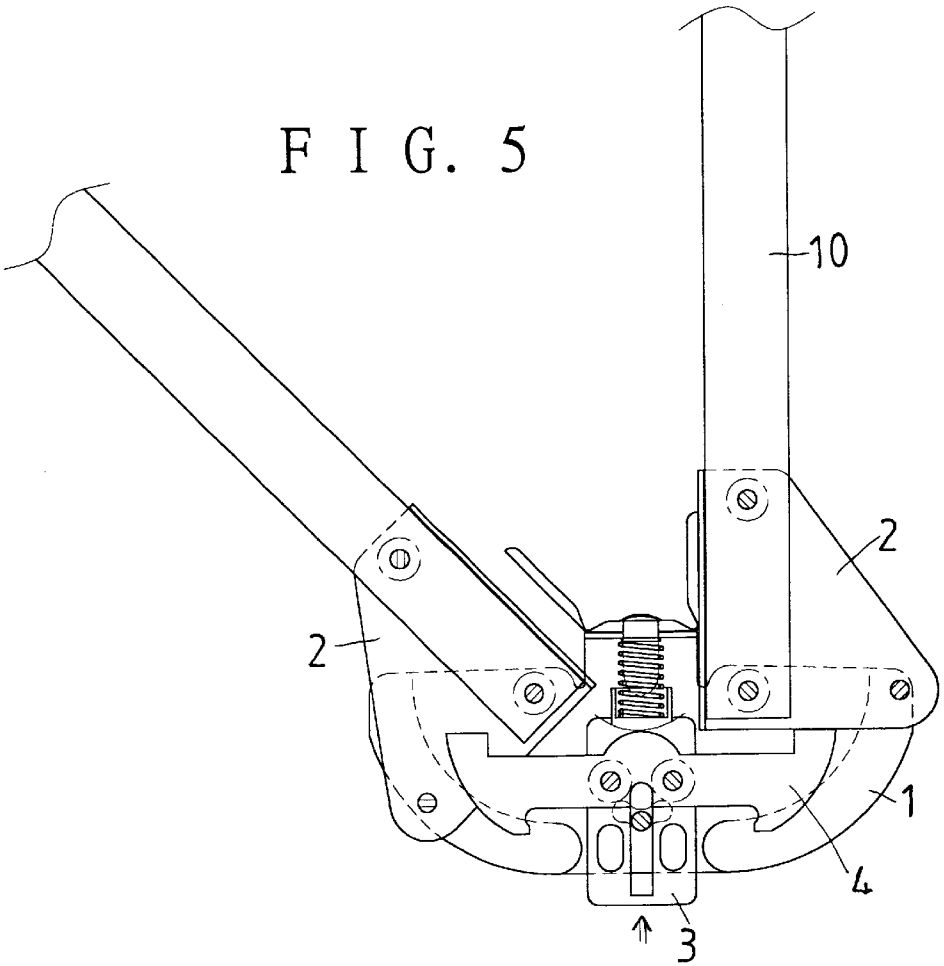
FIG. 5 is a cross-sectional view of the joint in FIG. 3, under a folding movement.

To fold the playen, referring to FIGS. 4, 5 and 6, first the support rods 10 are pivoted inwardly of the main base 1 to disengage the locating pins 24 from the barbs 42. Then, the depress block 3 is moved up and the support rods 10 are pivoted outwardly of the main base 1; the pins 24 will contact the guide curves 41 of the plate hooks 4 in the pivotal movement, permitting the joint to be folded.

Figure 7:
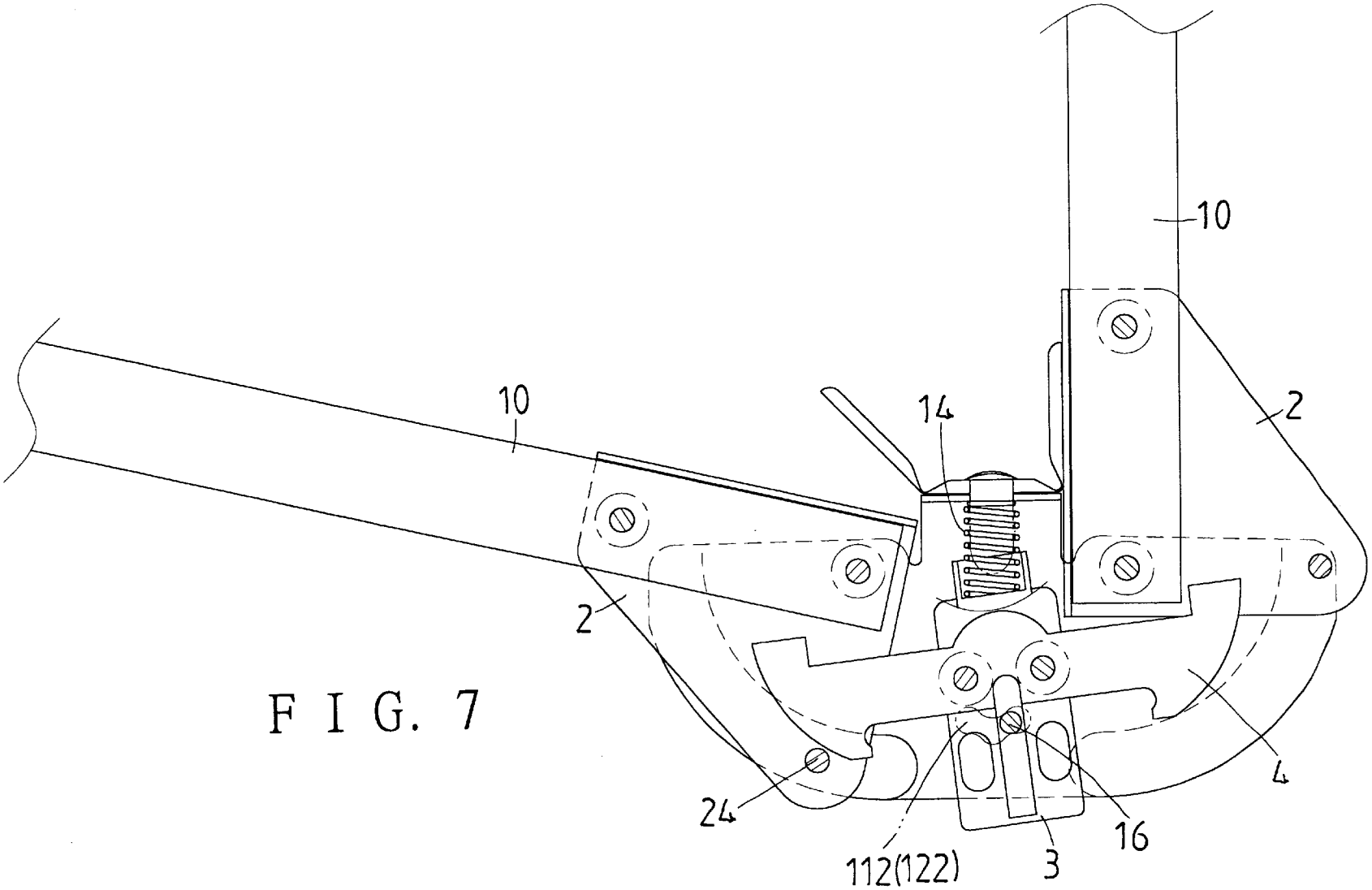
FIG. 7 is a cross-sectional view of the joint of the present invention with the press block being moved sideways in folding operation.
Figure 8:
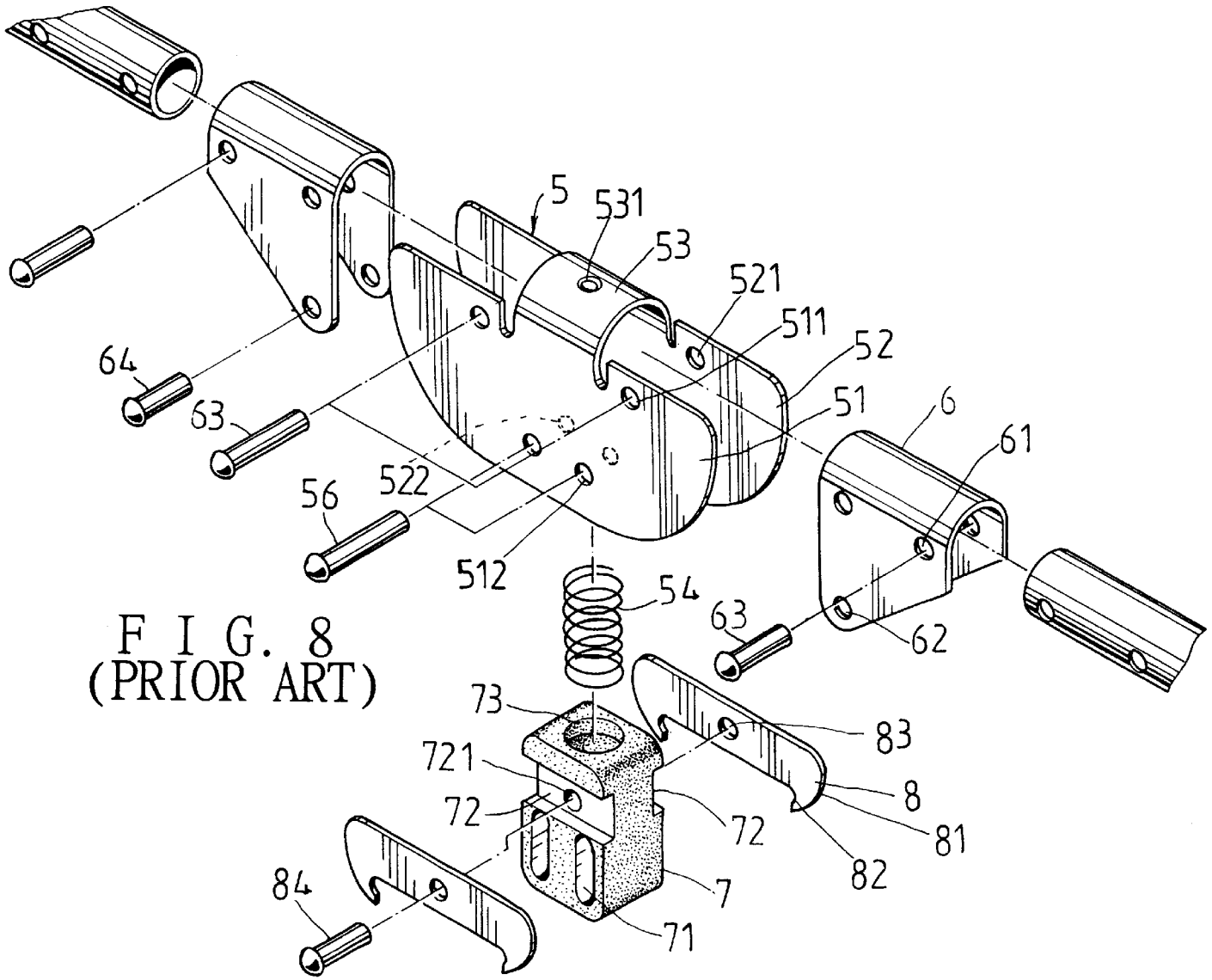
FIG. 8 (PRIOR ART)
FIG. 8 is an exploded perspective view of the conventional joint for a playen as described in the Background.
Figure 9:
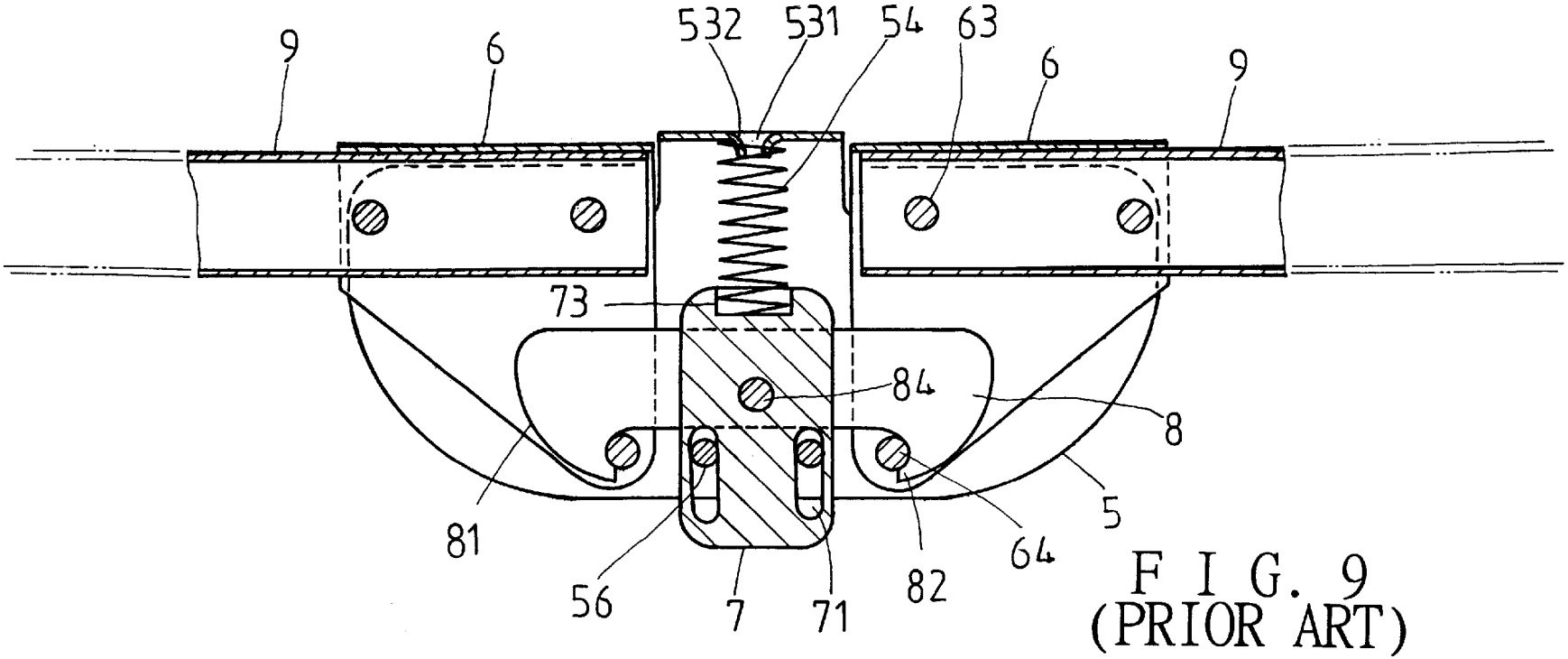
FIG. 9 (PRIOR ART)
FIG. 9 is a cross-sectional view of the conventional joint for a playen in FIG. 8.

Referring to FIG. 7, in case one of the wing bases 2 and the corresponding support rod 10 are not successfully moved to the folded position in the above step due to a tight connection between the wing base 2 and the main base 1, and the corresponding locating pin 24 still engage the barbs 42, the locating pin 24 can be separated from the barb 42 when the user pivot the support rod 10 because of the shape of the shaped holes 112, 122, permitting the press block 3 to move sideways. Thus, the support rods 10 and the associated parts cannot get damaged when the user continue to pivot one of the support rods 10 with the corresponding locating pin 24 still engaging the barbs 42.

From the above description, the joint of a playen of the present invention can be known to have a desirable feature: the joint can be folded more easily than the conventional one without possibility of damaging the parts due to the user's incorrect folding operation.

What is claimed is:

1. A joint for a playen, comprising a main base having two lengthwise side portions and an upper arch-shaped bridge connecting upper ends of said lengthwise side portions;

said lengthwise side portions each having a shaped hole on a middle part; said shaped holes being aligned with each other each said having a central portion and two side extension portions;

two wing bases pivoted to said lengthwise side portions of said main base; said wing base being each connected to a support rod of said playpen; said wing bases each having a locating pin fitted thereto;

a press block movably disposed under said arch-shaped bridge, said press block being biased downwardly by a spring disposed between said press block and said bridge; said press block having a long vertical guide hole with a guide pin passed therethrough; said guide pin being passed through said shaped holes of said main base to confine a movement of said press block within said long vertical guide hole and said shaped holes;

elongated plate hooks fitted to said press block; plate hooks each having two barbs at two ends, engaging a corresponding one of said locating pins of said wing bases to support said support rods at a spread position; said wing bases being pivotable to a folded position when said support rods are biased inwardly of said main base to separate said locating pins from said barbs and said press block is pressed up; said guide pin of said press block being movable into one of said side extension portions of said shaped holes when one of said locating pins fails to disengage from said barbs, permitting said press block to move sideways for disengagement of said locating pin from said barbs, and pivotal movement of a corresponding one of said wing base.

* * * * *